US005966856A

United States Patent [19]

Alu

[11] Patent Number: 5,966,856

[45] Date of Patent: Oct. 19, 1999

[54] ILLUMINATED SIGN LIGHT BOX

[76] Inventor: T. Bryan Alu, 727 8th St., Boulder, Colo. 80302

[21] Appl. No.: 08/619,015

[22] Filed: Mar. 20, 1996

[51] Int. Cl.[6] ..... G09F 13/00

[52] U.S. Cl. ..... 40/564; 40/545

[58] Field of Search ..... 40/564, 541, 568; 362/241, 267, 297, 346, 247

[56] References Cited

U.S. PATENT DOCUMENTS

| | | | |
|---|---|---|---|
| 1,808,456 | 6/1931 | Dwyer et al. | 40/564 |
| 1,858,755 | 5/1932 | Van Wyck et al. | 40/564 |
| 2,029,221 | 1/1936 | Burgess et al. | 40/574 |
| 2,038,409 | 4/1936 | Bone | 40/564 |
| 2,080,679 | 5/1937 | Vissing . | |
| 2,182,233 | 12/1939 | Pearlman | 40/545 |
| 4,602,448 | 7/1986 | Grove | 40/573 X |
| 4,667,428 | 5/1987 | Elmer | 40/592 |
| 4,669,033 | 5/1987 | Lee | 362/346 X |
| 5,398,170 | 3/1995 | Lee . | |

*Primary Examiner*—Cassandra H. Davis
*Attorney, Agent, or Firm*—Jay R Beyer

[57] ABSTRACT

An illuminated sign or light box includes a face having face material forming a desired face design with at least a portion of the desired face design comprising a light transmitting, substantially non-diffusing window. At least one tubular fluorescent light bulb is positioned behind the face. A substantially specular reflector which serves as a mirror is positioned behind the fluorescent light bulb. The reflector has a predetermined shape and the fluorescent light bulb is positioned such that when the sign or light box is viewed by a viewer from a predetermined viewing region, the viewer either directly sees the fluorescent light bulb or directly sees a substantially specular reflection of the fluorescent light bulb through the light transmitting, substantially non-diffusing window portions of the sign face.

12 Claims, 4 Drawing Sheets

ILLUMINATED SIGN LIGHT BOX

BACKGROUND OF THE INVENTION

The present invention relates generally to illuminated signs and light boxes. More specifically the invention relates to a backlit illuminated sign which is easily changeable and is as bright or in many instances substantially brighter than neon, even in daylight. This provides a sign that is more flexible than neon and, most important, substantially less expensive to manufacture. Over the years, neon signs have remained a popular choice for window signs, point of purchase signs, and other promotional signs due to their ability to capture customers attention. Throughout this description, the industry accepted term neon is used as a generic term which includes all cold cathode luminous tubes regardless of the specific type of inert gas used to fill the tube. One of the reasons neon signs are so effective is that the luminous tube of the neon sign is typically viewed directly by the observer rather than having a light source located behind a diffusing sign face as is the case for conventional backlit signs. Because the observer is able to look directly at the light source of the neon sign, this type of sign is able to stand out in a wide variety of ambient lighting situations including direct sunlight. Also, neon provides a three dimensional aspect to a sign which is not possible using conventional backlit signs. This three dimensional aspect adds significantly to the appeal of neon signs. However, the typical neon sign has several major drawbacks.

Traditional neon signs are made using glass tubing which is bent by a skilled neon glass bender. This results in several of the major disadvantages of neon signs. First, the bending of the luminous tube which makes up the neon sign is a relatively expensive process due to the labor involved. It has proved to be very difficult to reduce this cost by automating the tube bending process. Second, since conventional neon signs are made up of custom bent luminous tubes, they are not easily changeable in situations where it is desirable to change the design of the face of the sign from time to time. If the design of the neon sign becomes outdated or if the message on the sign needs to be changed, an entirely new and expensive custom bent tube must be produced and the sign must be reassembled by a qualified neon sign servicer in order to make any changes. And third, luminous tubes are only available in certain colors and certain tube diameters. Because of this, the design of the neon sign is limited to these certain colors and limited to designs made up of lengths of these certain diameter bent tubes. This makes it difficult to reproduce design features such as large patches of evenly lighted areas or other design features that can not be reproduced using the linear characteristics of neon tubes.

Another disadvantage of typical neon signs is that they require relatively high voltages to light the neon tube. These high voltages associated with neon signs create more difficult safety concerns compared with other types of signs used to provide small portable signs which are often to be handled by sign owners rather than a qualified sign servicer. The high voltages of neon signs require the use of more expensive components for insulating and properly isolating the high voltages from potential contact with the general public and people handling the signs. Also, the more specialized construction of the neon sign necessitated by the high voltages makes it virtually impossible for the typical sign owner to safely and properly service their own sign. For example, a sign owner may be able to safely replace a burned out fluorescent bulb in a typical backlit sign, however, the owner would not typically be able to safely replace a neon tube in a neon sign.

Another problem with neon signs is that the glass tubing making up a neon sign is extremely fragile making it difficult to manufacture the sign at a central location and ship the sign to the final destination without suffering a significant amount of shipping damage. This problem of transporting neon signs further increases the costs of the sign. To overcome this problem, neon signs are often produced locally to avoid shipping. However, this prevents manufacturers from being able to achieve significant economies of scale.

Over the years, several different approaches have been proposed to overcome the above described problems associated with typical neon signs while still retaining the same attention grabbing characteristics associated with neon signs. U.S. Pat. No. 2,080,679, issued to Ellinn D. Vissing, apparently attempts to overcome the flexibility problems associated with neon signs. Specifically, Vissing describes a neon sign using a grid of zig zagged, parallel running luminous tubes (e.g. neon) which are used in combination with reflectors to backlight a changeable sign face. The sign face is coated with an opaque coating which may then be selectively erased to form a desired design on the face of the sign. This approach addresses the problem of changeability of the sign face but still requires a luminous tube to be bent into the zig zag shape resulting in an expensive sign due to the labor involved. Also, since a luminous tube is used, the sign is limited to the color or colors of the tubes selected for backlighting. Furthermore, the problems described above associated with the high voltage, the servicing of the sign, and the fragile nature of the luminous tube all still remain using this approach.

In another approach currently being utilized which was developed subsequent to the neon tube approach just described, curvilinear grooves having a desired sign face design are etched into two sheets of glass. These sheets of glass are laminated together with the etched grooves adjacent to one another forming a tubular opening within the resulting laminated sheets of glass. The tubular opening within the sheets of glass is vacuum pumped, filled with gas, and sealed in a manner similar to conventional luminous tubes to form the face of a neon sign. This approach allows the process of forming the sheets of glass to be automated using an etching machine to etch the two sheets of glass. Although this reduces the labor involved in forming the sign, this approach remains expensive due the high equipment and tooling costs. Furthermore, this approach still has the problems of not being easily changeable, being limited to certain colors and line shapes for design features, using high voltage, and the difficulties associated with servicing the sign as described above.

Presumably in an attempt to overcome some of the drawbacks described above, still another approach has been commercialized. This approach uses a completely different arrangement in an attempt to provide a sign with the visual impact of a neon sign. In this approach, a conventional fluorescent light bulb backlit sign light box is used. This light box backlights a sign face having an array of color tinted, light channeling pegs supported within the sign face to form a desired sign face design. The light channeling pegs are inserted through openings in the sign face with the back end of each peg exposed to the interior of the light box and the front end of each peg protruding through the front of the sign face. The back end of the light channeling pegs gather light from the light box and direct the light out through the front end of the pegs in a manner similar to fiber optic cable. This tends to give the viewer the impression that each peg is a small light bulb, LED, or other such light source. This approach uses standard fluorescent backlighting and results in a bright sign which therefore eliminates the problems associated with the high voltage used with neon signs. However, the process of inserting all of the required pegs necessary to form a desired sign face design is extremely labor intensive and therefore expensive, and the sign still has the problem of not being easily changeable. Also, this approach limits the sign face design to a design that can be formed using an array of pegs or dots and does not allow for continuous or linear features in the sign face design.

Other approaches using conventional fluorescent light bulb backlit signs have been used to attempt to simulate neon signs. Conventional fluorescent bulb backlit signs typically include one or more fluorescent light bulbs supported within the light box housing. The housing may include reflectors to help spread the light over the face of the sign. The interior of the housing and the reflectors are typically painted white to reflect the light and further aid in more evenly backlighting the sign face. The approaches using conventional fluorescent light bulb backlit signs to simulate neon signs typically include various sign faces coated with various coatings which are meant to fluoresce or glow in a manner similar to a luminous tube. Heretofore, these coatings have been light diffusing coatings since, prior to the present invention, viewing fluorescent light bulbs directly was generally taboo in the sign industry. These signs eliminate the high voltage problems associated with neon signs, provide for a relatively easily changeable sign face, and dramatically reduce the cost of the sign. However, because these coatings and the typical sign face associated with a conventional fluorescent light bulb backlit sign diffuse light, these approaches do not create the brightness and therefore the visual impact associated with directly viewed neon signs.

The present invention provides an arrangement for a fluorescent light bulb backlit sign that results in an illuminated sign which is capable of generally simulating the look of a neon sign and which provides a sign that is even brighter and more visually arresting than traditional neon signs. This sign arrangement provides an easily changeable sign face and allows complete flexibility in selecting colors, shapes, and other design features of the sign face. Because standard fluorescent light bulbs are used, this arrangement provides these advantages at a cost substantially less than that of a comparable neon sign. Also, by using standard fluorescent light bulbs, the servicing and safety problems associated with the high voltage used in neon signs are eliminated. Furthermore, since the fluorescent bulbs may be easily installed and replaced by the eventual sign owner, the fluorescent tubes may be removed from their sockets for shipping and properly packaged dramatically reducing the chances of shipping damage.

SUMMARY OF THE INVENTION

As will be described in more detail hereinafter, an illuminated sign or light box is herein disclosed. The sign or light box includes a sign or light box face having face material forming a desired face design with at least a portion of the desired face design comprising a light transmitting, substantially non-diffusing window. At least one tubular fluorescent light bulb, which preferably has a central longitudinal axis, is positioned behind the sign or light box face. A substantially specular reflector, which serves as a mirror, is positioned behind the fluorescent light bulb. In a preferred embodiment, the reflector or mirror has a longitudinal axis which is parallel with the longitudinal axis of the fluorescent light bulb. The reflector or mirror has a predetermined shape and the bulb is positioned such that when the sign or light box is viewed by a viewer from a predetermined viewing region, the viewer either directly sees the fluorescent light bulb or directly sees a substantially specular reflection of the fluorescent light bulb through any of the light transmitting, substantially non-diffusing window portions of the sign face.

In one preferred embodiment of the present invention, the sign or light box includes a plurality of laterally spaced, parallel fluorescent light bulbs, each of which has a central longitudinal axes. In this embodiment, the reflector defines a plurality of predetermined reflecting channels, each of which is arranged to reflect light from an associated one of the fluorescent light bulbs so that the bulbs or a mirror image of the bulb can be viewed from the predetermined viewing region through cooperating window portions of the sign face. The window portions can be colorless (i.e. transparent) or color tinted so long as the viewer can see the fluorescent bulbs directly or a reflected image of the bulbs through the window portions with substantially no diffusion.

The reflector may take a variety of specific forms. In one version, the reflector takes the form of at least one channel having a parabolic cross sectional shape defining a focal point along a line parallel with the longitudinal axis of the reflector channel. With this arrangement, each fluorescent light bulb is positioned between the reflector and the face with the central longitudinal axis of the fluorescent light bulb substantially coinciding with the focal point of an associated one of the parabolic shaped channel of the reflector. In another version, the predetermined cross sectional shape of the reflector channel takes the form of at least one faceted, generally concave shape and the channel itself defines a longitudinal axis. In this case, each fluorescent light bulb is located at a predetermined position within an associated, faceted, generally concave shaped channel of the reflector with the central longitudinal axis of the fluorescent light bulb being parallel with the longitudinal axis of the reflector channel. Alternatively, the predetermined cross sectional shape of the reflector may take the form of a generally flat sheet material having a Fresnel type reflective surface formed into the sheet material which approximately simulates at least one parabolic reflector shape having a focal point along a line parallel with the longitudinal axis of the reflector. With this version, the fluorescent light bulb is positioned between the reflector and the face with the central longitudinal axis of the fluorescent light bulb substantially coinciding with the focal point of the Fresnel type reflector.

A variety of face materials may be used to form the face of the sign or light box. In one embodiment, the face material includes a light transmitting, substantially non-diffusing color dyed gel. In another embodiment, the face material includes a light transmitting, substantially non-diffusing silk screen ink. In still another embodiment, the face material includes a photographic film material having portions of which are light transmitting and substantially non-diffusing.

In another embodiment, the predetermined viewing region for the sign or light box is a region defined by a spread angle above and below the plane extending through the longitudinal axis of the reflector and normal to the face of the sign or light box. The spread angle is selected to be a desired spread angle to suit the specific application in which the sign or light box will be used. The desired spread angle is used to determine the specific diameter of the fluorescent light bulb to be used and to determine the specific dimensional positioning and shape of the reflector to be used. In any of the embodiments described thus far, the positional relationship between the fluorescent light bulb(s) and reflector channel(s) can be varied in order to vary the size of the viewing region.

For example, in an embodiment using a single channel parabolic shaped reflector, the predetermined viewing region is an region generally defined by a spread angle $\phi$ above and below the plane extending through the longitudinal axis of the parabolic reflector and normal to the face of the sign or light box. The spread angle $\phi$ is selected to be a desired spread angle to suit the specific application in which the sign or light box will be used. The desired spread angle $\phi$ is used to determine the specific focal length A of the parabolic reflector for any specific radius RL of the fluorescent light bulb using the formula $\tan \phi = RL(1-\cos \beta)/2A$. The angle $\beta$ is the angle measured from a line normal to the face to a line running through the center of the fluorescent light bulb and through a particular point on the reflective surface of the parabolic reflector. In a preferred version of this embodiment, the cross sectional overall width of the parabolic reflector is substantially maximized for a given spread angle by having the overall width of the parabolic shaped reflector being approximately equal to four times the focal length of the parabolic reflector. Also, the cross sectional parabolic shape of the reflector extends from behind the fluorescent light bulb up to approximately the plane which is formed through the central axis of the fluorescent light bulb and which is generally parallel with the face of the sign or light box.

BRIEF DESCRIPTION OF THE DRAWINGS

The features of the present invention may best be understood by reference to the following description of the presently preferred embodiments together with the accompanying drawings in which.

DETAILED DESCRIPTION OF THE PREFERRED EMBODIMENTS

Figure 1A:
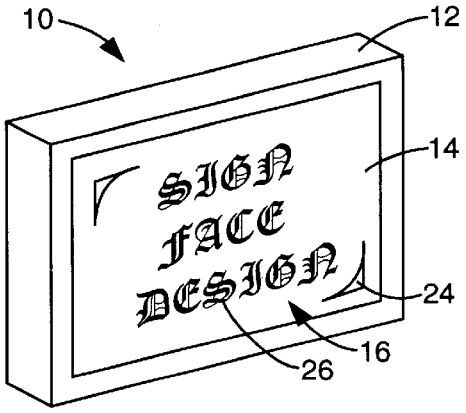
FIG. 1A is a diagrammatic perspective view of an illuminated sign in accordance with the present invention including a sign face having a desired sign face design.
Figure 1B:
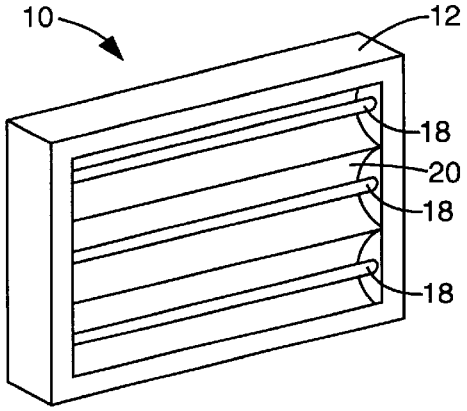
FIG. 1B is a diagrammatic perspective view of the sign shown in FIG. 1A with the sign face removed.
Figure 2:
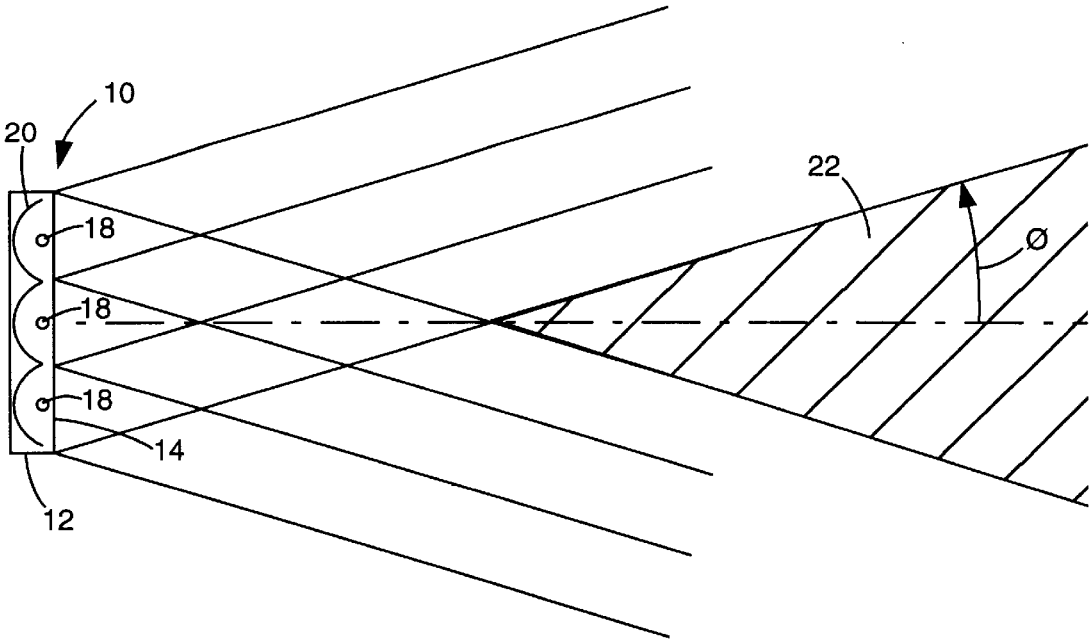
FIG. 2 is a diagrammatic cross sectional side view of the sign shown in FIG. 1A illustrating the viewing region from which the sign is designed to be viewed.

Turning to the drawings, wherein like components are designated by like reference numerals throughout the various figures, attention is initially directed to FIGS. 1A, 1B, and 2. These figures illustrate an illuminated sign, generally designated by reference numeral 10, including a housing 12. As shown in FIG. 1A, the housing supports a removable sign face 14 which has a desired sign face design 16 attached to or formed on sign face 14. In accordance with the invention, at least a portion of sign face design 16 is made up of a light transmitting, substantially non-diffusing window. This window portion of the sign face may be completely transparent, or in some way color tinted, so long as a viewer can see through the window portion with substantially no light diffusion.

As illustrated in FIG. 1B, in this embodiment, housing 12 also supports three standard fluorescent light bulbs 18 which are positioned behind sign face 14 (not shown in FIG. 1B). Fluorescent light bulbs 18 are positioned with their longitudinal axes being horizontal, laterally spaced, and parallel to one another within sign 10. Housing 12 further supports a substantially specular reflector 20 which acts as a mirror and which in this embodiment has a longitudinal axis parallel with the longitudinal axis of the fluorescent light bulbs. The reflector is positioned behind fluorescent bulbs 18 as most clearly shown in FIG. 2. As will be described in more detail hereinafter, specular reflector or mirror 20 has a predetermined cross sectional shape for reflecting light from fluorescent light bulbs 18 into a predetermined viewing region 22 indicated by the cross hatched region of FIG. 2.

In accordance with the present invention, when sign 10 is viewed by a viewer from predetermined viewing region 22, the configuration of specular reflector 20 and fluorescent light bulbs 18 causes the viewer to either see the fluorescent light bulbs directly or see a substantially specular reflection of the fluorescent light bulbs through any of the light transmitting, substantially non-diffusing window portions of the sign face. In other words, when the viewer is within predetermined viewing region 22, every point on sign face 14 appears as though the viewer is looking directly at a fluorescent light bulb if the sign face is transparent at that point. Therefore, when the sign is on, any of the window portions of the sign face (that is portions that are left transparent or that are covered with a light transmitting, non-diffusing sign face material) appear to have the intensity of looking directly at the fluorescent light bulb when viewed from viewing region 22.

With the above described sign arrangement, a wide variety of signs such as the neon signs and fiber optic signs described in the background of the invention may be simulated by simply placing an appropriately color tinted, light transmitting, non-diffusing sign face material having the appropriate shape over the portions of the sign face in which the neon tubes or fiber optic pegs would be located. Using this novel approach, the light transmitting, non-diffusing window portions of the sign face provide a three dimensional appearance since the viewer is able to see through these window portions. As is the case for neon signs, this three dimensional aspect of the sign significantly contributes to the eye catching appeal of the sign. However, because fluorescent light bulbs are significantly brighter than neon or other luminous tubes, this arrangement results in a brighter, more visually arresting sign. Also, this arrangement allows for complete flexibility in sign face design since any desired portions of the sign face may be covered with any desired color of material having any degree of light transmission and any degree of light diffusion. Furthermore, because the sign face is removable, the sign may be inexpensively changed by simply replacing the sign face itself.

As mentioned above in the background, because the sign of the present invention utilizes standard fluorescent light bulbs, the servicing and safety problems associated with a neon sign are avoided. Also, since a sign owner may easily install or replace the standard fluorescent tubes, the tubes may be removed and properly packaged for shipping thereby reducing the chances of shipping damage compared with a neon sign in which the neon tubes may not be easily removed from the sign.

Still referring to FIG. 2, a desired spread angle $\phi$ is used to define the predetermined viewing region 22. In this embodiment, viewing region 22 includes the region defined by spread angle $\phi$ both above and below the plane extending along the longitudinal axis of the fluorescent tubes and normal to the sign face. As will be described in more detail hereinafter, the desired spread angle which defines the viewing region is used to determine the specific size, shape, and positioning of specular reflector 20 and fluorescent light bulbs 18. By properly selecting the size, shape, and position of the specular reflector and the light bulbs, this arrangement insures that the viewer sees the fluorescent light bulbs directly or a specular reflection of the light bulbs through any of the light transmitting, non-diffusing window portions of the sign face when viewing the sign from predetermined viewing region 22.

Although the embodiment described above includes three horizontally positioned fluorescent light bulbs, this is not a requirement of the invention. Any number of fluorescent bulbs arranged in any desired orientation may be utilized so long as the reflector(s) and fluorescent bulb(s) are arranged such that when a viewer views the sign from the predetermined viewing region, the viewer either directly sees the fluorescent light bulb or directly sees a substantially specular reflection of the fluorescent light bulb through any of the light transmitting, substantially non-diffusing window portions of the sign face. Also, although the invention has been described to this point as being an illuminated sign, it may alternatively be a light box for backlighting a variety of materials other than a sign face. For example, sign 10 may take the form of a light box for backlighting photographic transparencies or other film materials which include light transmitting, non-diffusing window portions.

A wide variety of sign face materials may be utilized to form the sign face. For example, conventional opaque sign vinyl, opaque silk screen materials, or other opaque materials may be used to form portions of the sign face that are to be non light transmitting. Also, conventional light diffusing vinyl material, light diffusing silk screen inks, or other such conventional light diffusing materials may be used to form conventional appearing backlit portions of the sign such as background areas or lettering which are intended to be more subdued. However, for the portions of the sign which are intended to have the brightest features, the sign face is ether left transparent, or a light transmitting, non-diffusing material is used to form these window portions of the sign face. As described above, these light transmitting, non-diffusing window portions of the sign face allow the viewer to see the fluorescent light bulbs directly or see specular reflections of the light bulbs through these window portions making it appear to the viewer as though they are looking directly at a light source. This provides the same three dimensional, visually arresting characteristics of neon signs with the added advantage that the fluorescent light bulbs are substantially brighter than the luminous tubes used in neon signs. Therefore, this arrangement provides an even more attention grabbing and brighter sign than conventional neon signs and conventional backlit signs.

Any light transmitting, non-diffusing material may be used to form the window portions of the sign face. Typically the sign face includes a transparent glass panel or plastic film or panel material as the sign face substrate. However, the sign face substrate itself may be a color tinted plastic or glass which does not diffuse light. Applicant has found that light transmitting, non-diffusing color dyed gels such as those used in the theater industry may be used to provide a wide variety of color tints for these window portions of the sign face. In this situation, a piece of the desired colored gel is cut to a desired shape and attached to the sign face substrate. As illustrated in FIG. 1A, this shape may be any design feature of the sign face such as design feature 24 or lettering 26. The piece of colored gel is preferably attached to the interior surface of the sign face (in this particular case the sign face is a transparent plastic panel) at the desired location on the sign face. Since the sign face is transparent and the gel material is non-diffusing, the viewer sees through the gel to see either the fluorescent bulb directly or a specular reflection of the fluorescent bulb as described above. This causes the area covered by the gel to appear to the viewer as though it is a light source having the color of the gel material.

Another preferred sign face material for the light transmitting, non-diffusing window portions of the sign face is light transmitting, non-diffusing silk screen ink. This material has the advantage that once a sign face design is decided on, a large number of sign faces may be very economically produced by simply silk screening the desired sign face design onto the sign face using the appropriate silk screen inks. These inks may include opaque inks, light diffusing inks, and non-diffusing inks. As described above for the color dyed gels, the portions of the sign face covered with light transmitting, non-diffusing silk screen inks appear to the viewer to be light sources having the color of the silk screen ink.

Figure 5A:
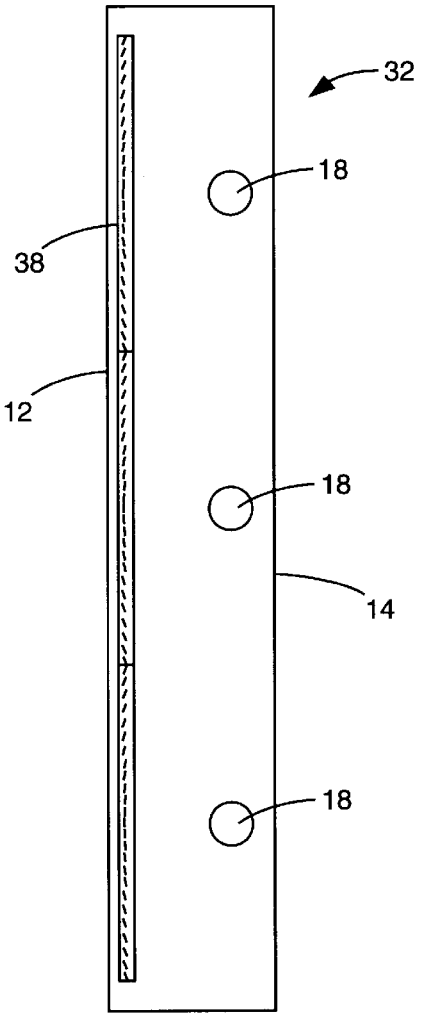
FIG. 5A is a diagrammatic cross sectional view of another embodiment of a sign in accordance with the present invention including a flat sheet material having Fresnel type reflectors formed into the sheet material.
Figure 4:
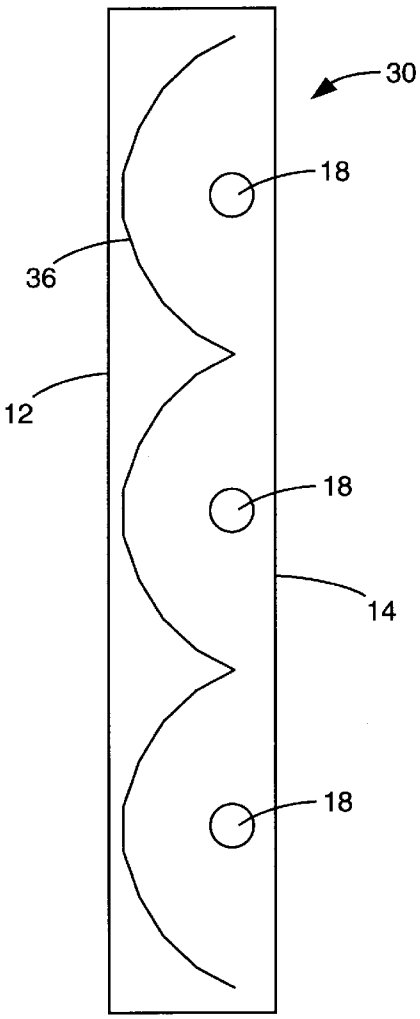
FIG. 4 is a diagrammatic cross sectional view of another embodiment of a sign in accordance with the present invention including faceted, generally concave shaped reflectors.
Figure 3:
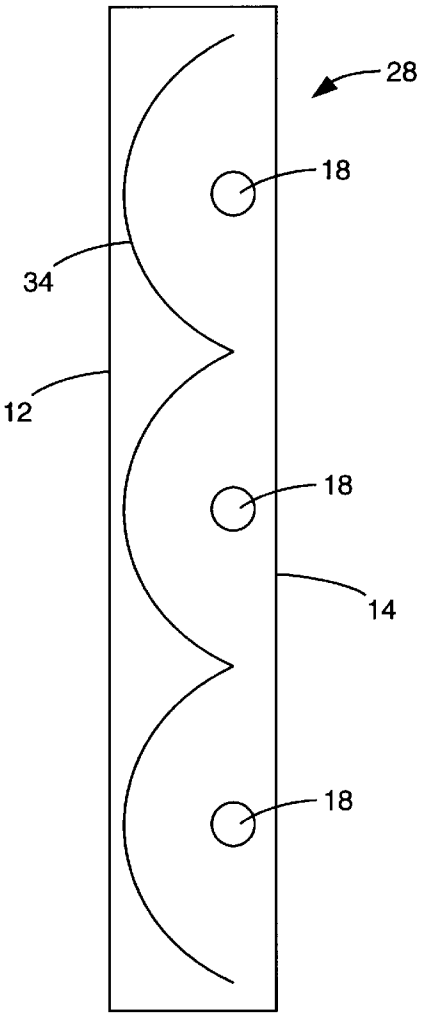
FIG. 3 is a diagrammatic cross sectional view of one embodiment of a sign in accordance with the present invention including parabolic shaped reflectors.

Now that the general configuration and characteristics of the sign have been described and the various sign face materials have been described, several specific embodiments of the specular reflector will be described in detail. The reflector may take on a variety of specific cross sectional shapes and still remain within the scope of the invention so long as the reflector is arranged to direct light from the fluorescent light bulbs into the predetermined viewing region such that a viewer sees one of the fluorescent bulbs directly or a specular image of one of the bulbs when viewing a transparent or non-diffusing window portion of the sign face from the predetermined viewing region. FIGS. 3, 4, and 5A illustrate three preferred embodiments of signs designed in accordance with the invention with the signs being generally designated by reference numerals 28, 30, and 32 respectively. Each of signs 28, 30, and 32 include a housing 12, a sign face 14, and fluorescent light bulbs 18 as described above.

Referring to FIG. 3, sign 28 includes a specular reflector 34 forming channels having a parabolic cross sectional shape that defines a focal point along a line parallel with the longitudinal axis of the reflector channel. Reflector 34 is positioned behind fluorescent light bulbs 18 such that each of the focal points of the parabolic channels coincides with the central axis of an associated one of the fluorescent light bulbs. As will be described in more detail hereinafter, since the fluorescent light bulb is placed with its central axis located generally at the focal point of the parabolic cross sectional shape of the reflector and since the light is emitted from the surface of the fluorescent light bulb, the reflector directs light from the fluorescent light bulb through the sign face with a certain spread angle. This spread angle is a function of the specific size and position of the light bulb and the reflector surface.

Referring to FIG. 4, sign 30 includes a specular reflector 36 forming four channels with each of the channels having a faceted, generally concave cross sectional shape. These faceted, generally concave shapes are formed to simulate a parabolic shape and are arranged to function in the same manner as described above for reflector 34. Although these shapes do not have a true focal point, the fluorescent bulbs are positioned with the central axis of the fluorescent bulbs generally at the point which best approximates the focal point of the parabolic shape the faceted surface most closely simulates. This arrangement allows the reflector to be formed from a sheet of specular reflective material by simply bending the reflector along its longitudinal axis at certain predetermined points to form each of the facets of the faceted, concave cross sectional shape.

Figure 5B:
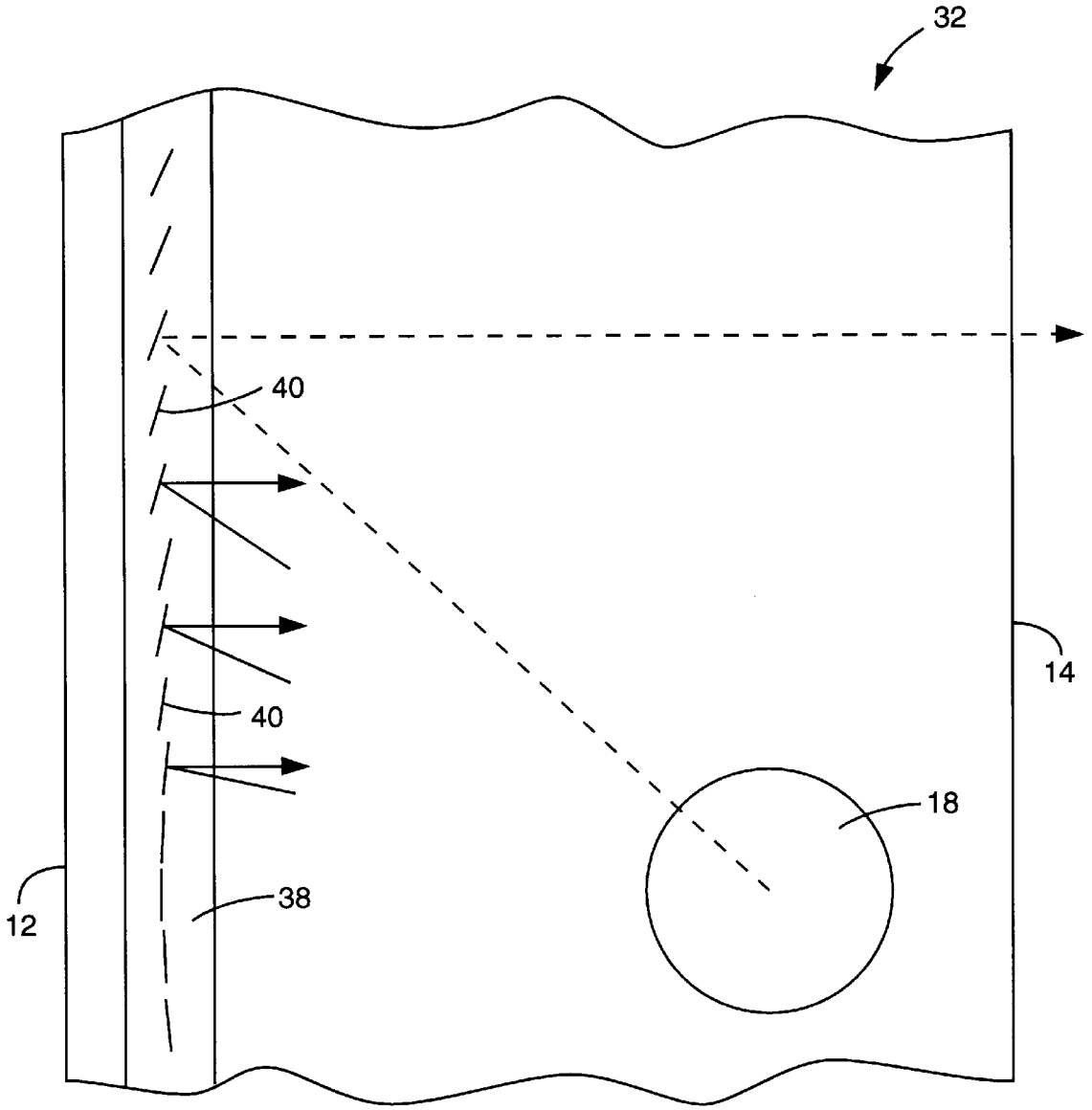
FIG. 5B is an enlarged, broken away cross sectional view of the sign shown in FIG. 5A.

Referring to FIGS. 5A and 5B, a third embodiment of a reflector in accordance with the invention will be described. As shown in FIG. 5A, sign 32 includes a generally flat sheet material reflector 38. Reflector 38 includes a Fresnel type specular reflective surface formed into the flat sheet material. The Fresnel type specular reflective surface is arranged to simulate a parabolic reflector such as reflector 34 described above. As illustrated in FIG. 5B, the Fresnel type reflective surface is made up of incrementally positioned, angled reflective surfaces 40. These reflective surfaces may be formed within the flat sheet reflector 38 as shown, or alternatively, may be formed on the surface of reflector 38 facing fluorescent light bulbs 18. Reflector 38 may be formed as a continuous sheet having a cross sectional configuration which simulates multiple parabolic reflectors as illustrated in FIG. 5A. Alternatively, reflector 38 may be made up of the appropriate number of strips of material with each strip simulating one parabolic reflector associated with one of the fluorescent light bulbs. As described above for the other embodiments of the reflector, reflector 38 is positioned such that the focal point of the simulated parabolic reflector generally coincides with the central axis of the fluorescent light bulb.

As mentioned above, for each of the described reflector arrangements, the specific size and positioning of the fluorescent light bulbs and the reflectors may be determined based on the desired spread angle of the desired viewing region. Since faceted reflector 36 and Fresnel type reflector 38 are both arranged to simulate a parabolic reflector, these size and positioning relationships will be described in terms of a parabolic reflector.

Figure 6:
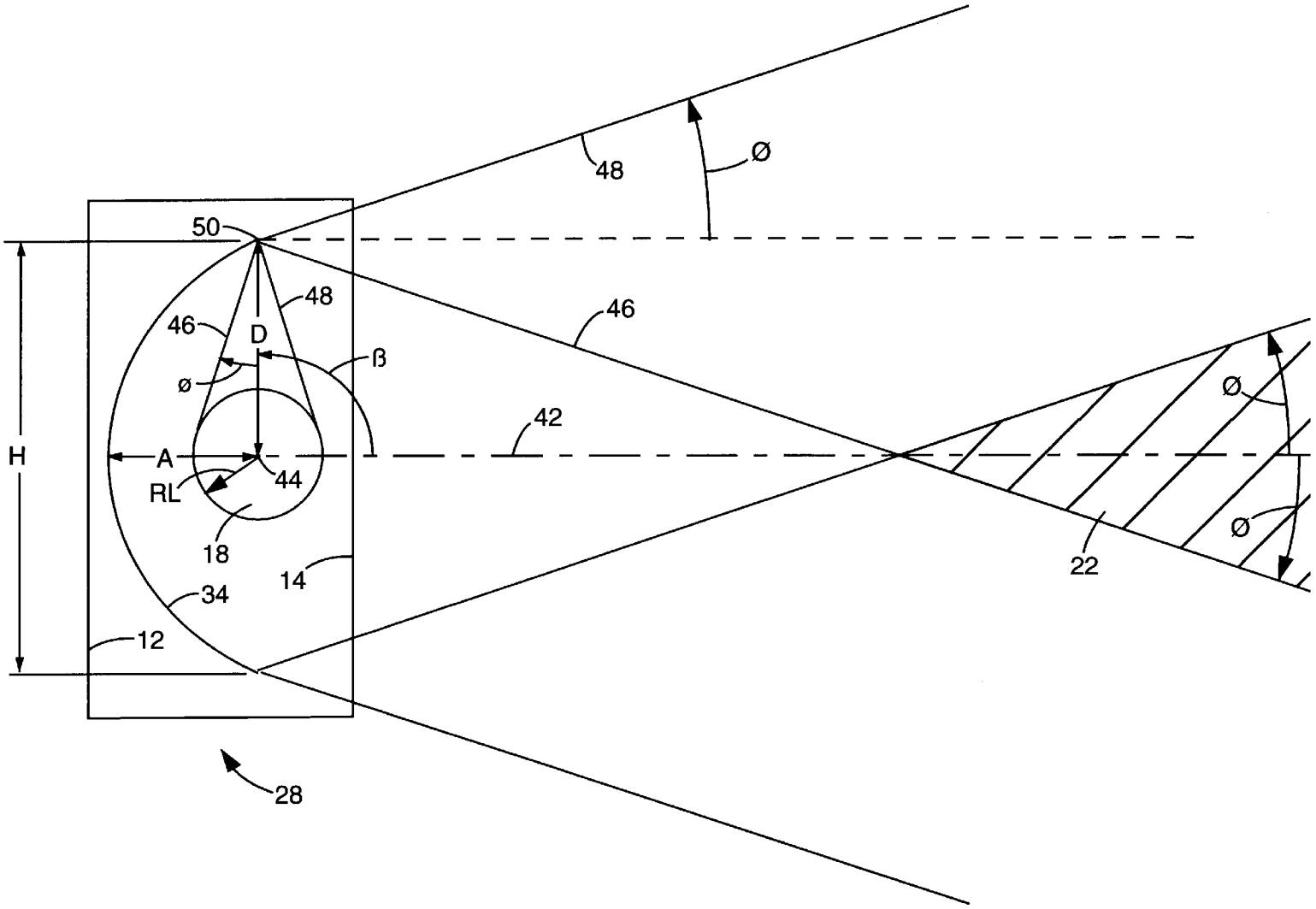
FIG. 6 is an enlarged diagrammatic cross sectional view illustrating the relationship between a particular spread angle associated with a predetermined viewing region and the dimensional sizes and positions of a parabolic reflector and a fluorescent light bulb arranged in accordance with the present invention.

FIG. 6 illustrates an enlarged view of a cross sectional portion of sign 28 of FIG. 3. The portion of sign 28 shown includes one of the cross sectional parabolic shapes making up reflector 34, one of fluorescent light bulbs 18, a portion of housing 12 behind reflector 34, a portion of sign face 14 in front of fluorescent bulb 18, and the desired viewing region 22 indicated by the cross hatched region. Parabolic reflector 34 has a focal point located a distance A from the back of the reflector. Fluorescent light bulb 18 is positioned with its central axis coinciding with the focal point of the reflector. As shown in FIG. 6 and as described above for FIG. 2, viewing region 22 includes the region defined by spread angle $\phi$ both above and below the plane 42 extending along the longitudinal axis of the fluorescent tubes (indicated at point 44) and normal to the sign face. In accordance with the present invention, this spread angle $\phi$ is used to determine the size and positioning of fluorescent bulb 18 and reflector 34. Since standard fluorescent bulbs are only available in certain diameters, these diameters may be used to determine the size, shape, and positional relationship between reflector 34 and bulb 18 in order to obtain the desired spread angle $\phi$ for a given bulb diameter. In FIG. 6, radius RL corresponds to the radius of fluorescent light bulb 18.

In order to insure that the viewer of the sign always sees the fluorescent light bulb or a specular reflection of the fluorescent light bulb through light transmitting, non-diffusing window portions of the sign face when viewing the sign from viewing region 22, each point on the reflector surface must reflect light from bulb 18 into the viewing region with a spread angle equal to or greater than the desired spread angel $\phi$ associated with viewing region 22. Also, since a specular reflector must be used to provide a specular image of the light bulb, the spread angle associated with a given point on the reflector surface is dictated by straight lines extending from the outer edge of bulb 18 to that given point on the reflector. In FIG. 6, lines 46 and 48 indicate the boundaries of a spread angle $\phi$ associated with the outermost point 50 on parabolic reflector 34. Using parabolic reflector 34, this outermost point 50 is a distance D from the center of bulb 18. Point 50 has the smallest spread angle $\phi$ relative to any other point on the surface of the reflector. This is because point 50 is furthest from fluorescent light bulb 18. Therefore, since the spread angel $\phi$ associated with point 50 is the smallest spread angle associated with the reflector, it controls the spread angel $\phi$ associated with viewing region 22. Using these relationships, the dimension D may be calculated using the formula $D=RL/\tan\phi$.

The above described formula for D may be combined with the equation associated with a parabola having a focal length of A. The equation for a parabola may be written to identify the polar coordinates of any given point on the parabola relative to the focal point by solving the equation $D=2A/(1-\cos\beta)$ where $\beta$ is the angle from plane 42 (the plane normal to the sign face) to the line connecting the focal point (in this case point 44) to the given point on the parabola. The D expressed in the parabola equation is the same as the D expressed in the spread angle equation described above.

Combining the two equations described above results in the formula $\tan\phi=RL\,(1-\cos\beta)/2A$. This equation may be used to determine the focal length A, and therefore the shape of reflector 34, for any desired spread angel $\phi$ using a given fluorescent tube radius RL. Furthermore, since the expression $(1-\cos\beta)$ can never be greater than one, this formula shows that the height of the parabolic reflector, indicated by the letter H in FIG. 6, is maximized for a given situation when $\cos\beta=0$. This means that the height H is maximized when the parabolic reflector extends only up to the point that it intersects with the plane which is running through the focal point of the reflector (in this case point 44 which is the central axis of bulb 18) and which is parallel with the face of the sign. If this maximized configuration is chosen (that is when $\cos\beta=0$), since the height H would be equal to twice the distance D at the outermost point of the parabola, the above parabola equation $D=2A/(1-\cos\beta)$ means that the maximized height H of the parabolic reflector for any given focal length is equal to four times the focal length A.

By using the above described formulas, a wide variety of spread angles associated with a desired viewing region may be quickly and easily used to determine the dimensions and positional requirements for the fluorescent light bulbs and the reflectors making up the sign having the desired viewing region. These dimensions may be used to optimize the number of fluorescent light bulbs used in the sign and therefore minimize the cost. Furthermore, using this approach, the viewing region may be controlled to more efficiently use the light produced by the fluorescent light bulbs. Since the spread angle associated with the viewing region is reduced as the reflector height is enlarged for a given diameter fluorescent bulb, once a minimum acceptable spread angle for a desired viewing region is determined, the number of fluorescent bulbs may be optimized for the given situation.

Although the above described embodiments have been describe in terms of an illuminated sign, the present invention would equally apply to a light box used for other purposes. Also, as described above, although the reflector(s) and fluorescent light bulb(s) have been shown in a laterally spaced apart parallel configuration, this is not a requirement. The reflector(s) and fluorescent light bulbs(s) may be positioned in a wide variety of configurations and still remain within the scope of the invention. The invention would equally apply so long as the reflectors and fluorescent light bulbs are positioned such that when the sign or light box is viewed by a viewer from the predetermined viewing region the viewer either directly sees one of the fluorescent light bulbs or directly sees a substantially specular reflection of one of the fluorescent light bulbs through any of the light transmitting, substantially non-diffusing window portions of the sign face. Therefore, the present examples are to be considered as illustrative and not restrictive, and the invention is not to be limited to the details given herein, but may be modified within the scope of the appended claims.

What is claimed is:

1. An illuminated sign comprising:

a sign face including sign face material forming a desired sign face design, the sign face design having at least one light transmitting, substantially non-diffusing window portion;

at least one tubular fluorescent light bulb having a central axis, the fluorescent light bulb being positioned behind the sign face, and a substantially specular reflector which serves as a mirror positioned behind the fluorescent light bulb, the reflector taking the form of at least one reflector channel which approximately simulates a parabolic cross sectional shape defining a focal point along a line parallel with a longitudinal axis of the reflector channel, the fluorescent light bulb being positioned between the reflector and the sign face material with the central axis of the fluorescent light bulb substantially coinciding with the focal point of the reflector channel such that when the sign is viewed by a viewer from a predetermined viewing region, the viewer either directly sees the fluorescent light bulb or directly sees a substantially specular reflection of the fluorescent light bulb through the light transmitting, substantially non-diffusing window portions of the sign face, the predetermined viewing region being a region generally defined by a spread angle $\phi$ above and below a plane extending through the longitudinal axis of the reflector channel and normal to the sign face, the spread angel $\phi$ being selected to be a desired spread angle to suit a specific application in which the sign will be used, and the desired spread angel $\phi$ being used to determine a specific focal length A of the simulated parabolic reflector channel and therefore the cross sectional shape of the reflector channel to be used for any specific radius RL of the fluorescent light bulb using the formula $$\tan \phi = RL(1-\cos \beta)/2A$$

where $\beta$ is the angle measured from a line normal to the face of the sign to a line running through the center of the fluorescent light bulb and through a particular point on a reflective surface of the reflector channel.

2. An illuminated sign according to claim 1 wherein:

the illuminated sign includes a plurality of laterally spaced, parallel fluorescent light bulbs, each of which has a central longitudinal axes; and the reflector defines a plurality of predetermined reflector channels, each of which is arranged to cooperate with an associated fluorescent light bulb such that when the sign is viewed by a viewer from a predetermined viewing region defined by the spread angle $\phi$, the viewer either directly sees one of the fluorescent light bulbs or directly sees a substantially specular reflection of one of the fluorescent light bulbs through the light transmitting, substantially non-diffusing window portions of the sign face.

3. An illuminated sign according to claim 1 wherein the reflector takes the form of at least one channel having a faceted, generally concave cross sectional shape with a longitudinal axis parallel to the longitudinal axis of the reflector channel, and wherein the fluorescent light bulb is positioned between the reflector and the sign face with the central axis of the fluorescent light bulb parallel to the longitudinal axis of the reflector channel.

4. An illuminated sign according to claim 1 wherein the reflector takes the form of a generally flat sheet material having a Fresnel type reflective surface formed into the sheet material, the Fresnel type reflective surface approximately simulating at least one parabolic cross sectional shape defining a focal point along a line parallel with the longitudinal axis of the reflector, and wherein the fluorescent light bulb is positioned between the reflector and the sign face with the central axis of the fluorescent light bulb substantially coinciding with the focal point of the Fresnel type reflective surface.

5. An illuminated sign according to claim 1 wherein the reflector channel has a parabolic cross sectional shape that defines the focal point along the line parallel with the longitudinal axis of the reflector channel, and wherein the fluorescent light bulb is positioned between the reflector and the sign face material with the central axis of the fluorescent light bulb substantially coinciding with the focal point of the parabolic shaped reflector channel.

6. An illuminated sign according to claim 5 wherein the parabolic shaped reflector channel has a cross sectional overall width that is substantially maximized for a given spread angle by having the overall width of the parabolic shaped reflector channel be approximately equal to four times the focal length of the parabolic shaped reflector channel and by having the cross sectional parabolic shape of the reflector channel extend from behind the fluorescent light bulb up to approximately the plane which is formed through the central axis of the fluorescent light bulb and which is generally parallel with the face of the sign.

7. A light box for use in, for example, an illuminated sign, the light box comprising:

a housing adapted to support a light box face including face material forming a desired face design having a predetermined viewable face area;

at least one tubular fluorescent light bulb having a central axis; and a substantially specular reflector which serves as a mirror positioned behind the fluorescent light bulb, the reflector taking the form of at least one reflector channel which approximately simulates a parabolic cross sectional shape defining a focal point along a line parallel with a longitudinal axis of the reflector channel, the fluorescent light bulb being positioned with the central axis of the fluorescent light bulb substantially coinciding with the focal point of the reflector channel and the fluorescent light bulb and the reflector being positioned such that when the light box is viewed by a viewer from a predetermined viewing region without the light box face in place, the viewer either directly sees the fluorescent light bulb or directly sees a substantially specular reflection of the fluorescent light bulb when viewing any portion of the area defined by the viewable face area of the light box face if the light box face were supported in place by the housing, the predetermined viewing region being a region generally defined by a spread angle $\phi$ above and below a plane extending through the longitudinal axis of the reflector channel and normal to the light box face, the spread angel $\phi$ being selected to be a desired spread angle to suit a specific application in which the light box will be used, and the desired spread angel $\phi$ being used to determine a specific focal length A of the simulated parabolic reflector channel and therefore the cross sectional shape of the reflector channel to be used for any specific radius RL of the fluorescent light bulb using the formula $$\tan \phi = RL(1-\cos \beta)/2A$$

where $\beta$ is the angle measured from a line normal to the face of the light box to a line running through the center of the fluorescent light bulb and through a particular point on a reflective surface of the reflector channel.

8. A light box according to claim 7 wherein:

the light box includes a plurality of laterally spaced, parallel fluorescent light bulbs, each of which has a central longitudinal axes; and the reflector defines a plurality of predetermined reflector channels, each of which is arranged to cooperate with an associated fluorescent light bulb such that when the light box is viewed by a viewer from the predetermined viewing region without the light box face in place, the viewer either directly sees one of the fluorescent light bulbs or directly sees a substantially specular reflection of one of the fluorescent light bulbs when viewing any portion of the area defined by the viewable face area of the light box face if the light box face were supported in place by the housing.

9. A light box according to claim 7 wherein the reflector takes the form of at least one channel having a faceted, generally concave cross sectional shape with a longitudinal axis parallel to the longitudinal axis of the reflector channel, and wherein the fluorescent light bulb is positioned between the reflector and the light box face with the central axis of the fluorescent light bulb parallel to the longitudinal axis of the reflector channel.

10. A light box according to claim 7 wherein the reflector takes the form of a generally flat sheet material having a Fresnel type reflective surface formed into the sheet material, the Fresnel type reflective surface approximately simulating at least one parabolic cross sectional shape defining a focal point along a line parallel with the longitudinal axis of the reflector, and wherein the fluorescent light bulb is positioned between the reflector and the light box face with the central axis of the fluorescent light bulb substantially coinciding with the focal point of the Fresnel type reflective surface.

11. A light box according to claim 7 wherein the reflector channel has a parabolic cross sectional shape that defines the focal point along the line parallel with the longitudinal axis of the reflector channel, and wherein the fluorescent light bulb is positioned between the reflector and the light box face with the central axis of the fluorescent light bulb substantially coinciding with the focal point of the parabolic shaped reflector channel.

12. A light box according to claim 11 wherein the parabolic shaped reflector channel has a cross sectional overall width that is substantially maximized for a given spread angle by having the overall width of the parabolic shaped reflector channel be approximately equal to four times the focal length of the parabolic shaped reflector channel and by having the cross sectional parabolic shape of the reflector channel extend from behind the fluorescent light bulb up to approximately the plane which is formed through the central axis of the fluorescent light bulb and which is generally parallel with the light box face.

* * * * *